US006181887B1

(12) United States Patent
Hughes et al.

(10) Patent No.: US 6,181,887 B1
(45) Date of Patent: Jan. 30, 2001

(54) CONTROL SYSTEM UTILIZING VIRTUAL BELT HOLES

(75) Inventors: David A. Hughes; Michael B. Monahan, both of Webster; Orlando J. Lacayo, Rochester, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/471,863

(22) Filed: Dec. 23, 1999

(51) Int. Cl.[7] ..... G03G 15/00; G03G 15/01

(52) U.S. Cl. ..... 399/38; 347/116; 399/162; 399/298; 399/301

(58) Field of Search ..... 399/38, 160, 162, 399/298, 223, 301; 347/115, 116

(56) References Cited

U.S. PATENT DOCUMENTS 5,291,245 * 3/1994 Charnitski et al. ..... 399/160 X 5,784,676 * 7/1998 Iseki et al. ..... 399/301

* cited by examiner

*Primary Examiner*—Sophia S. Chen
(74) *Attorney, Agent, or Firm*—Kevin R. Kepner; William F. Eipert

(57) ABSTRACT

A system and method for controlling the imaging device in a single pass multi color electrophotographic printing machine, includes a photoconductive member defining a timing aperture, the member moving along a path in a printing machine and a plurality of imaging devices, each one of the plurality of imaging devices writing a latent image on the photoconductive member. The system further includes a sensor, located adjacent the photoconductive member, to sense the aperture in the photoconductive member as it passes the sensor and generate a signal indicative thereof and a control device, which generates a timing signal for each of the plurality of imaging devices as a function of the signal generated by the sensor and a plurality of predetermined parameters.

10 Claims, 5 Drawing Sheets

CONTROL SYSTEM UTILIZING VIRTUAL BELT HOLES

This invention relates generally to a control system for an electrophotographic printing machine and, more particularly, concerns a system which utilizes a variable pitch virtual belt hole scheme to control the formation of latent images on a photoconductive belt member.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color.

In single pass color machines and other high speed printers it is desirable to utilize as much of the surface area of the photoreceptor as possible to improve the efficiency and print speed of the printer. The photoreceptor typically has a seam therein which is an area of the photoreceptor that is unuseable for developing images thereon. A standard way of marking the seam is to have a hole located at a known distance therefrom and to trigger image formation from that hole. Many print jobs, however vary in the size of media used and it is therefore desirable to utilize the photoreceptor in what is known as a variable pitch mode. It is further desirable to utilize this variable pitch mode without having to change the belt to vary the pitch number for the particular print job.

In accordance with one aspect of the present invention, there is provided a system for controlling the imaging device in a single pass multi color electrophotographic printing machine, comprising a photoconductive member defining a timing aperture, the member moving along a path in a printing machine and a plurality of imaging devices, each one of the plurality of imaging devices writing a latent image on the photoconductive member. The system further includes a sensor, located adjacent the photoconductive member, to sense the aperture in the photoconductive member as it passes the sensor and generate a signal indicative thereof and a control device, which generates a timing signal for each of the plurality of imaging devices as a function of the signal generated by the sensor and a plurality of predetermined parameters.

In accordance with yet another aspect of the invention there is provided a method of controlling the formation of images on a photoconductive member in a multi color single pass electrophotographic printing machine comprising sensing a timing aperture in the photoconductive member as the member moves along a path in a printing machine and generating a timing signal for each of a plurality of imaging devices as a function of the signal sensed and a plurality of predetermined parameters.

Other features of the present invention will become apparent as the following description proceeds and upon reference to the drawings, in which.

Figure 1:
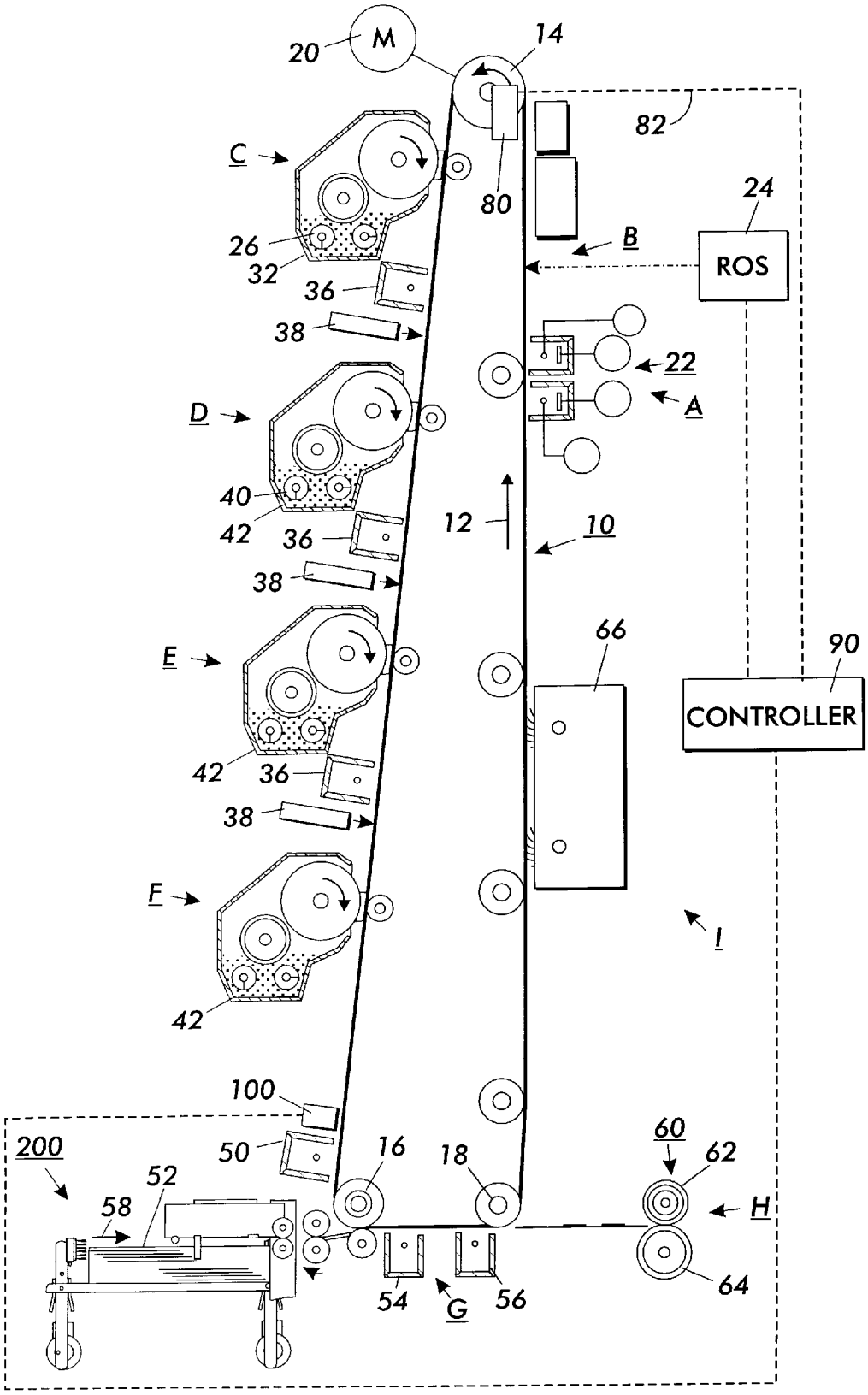
FIG. 1 is a schematic elevational view of a full color image-on-image single-pass electrophotographic printing machine utilizing the device described herein.

Turning now to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension rollers 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, receives the image signals from controller 100 representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_O$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C, developer structure, indicated generally by the reference numeral 32 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles 26 to be attracted to the electrostatic latent image. Appropriate developer biasing is accomplished via a power supply. This type of system is a noncontact type in which only toner particles (black, for example) are attracted to the latent image and there is no mechanical contact between the photoreceptor and a toner delivery device to disturb a previously developed, but unfixed, image.

The developed but unfixed image is then transported past a second charging device 36 where the photoreceptor and previously developed toner image areas are recharged to a predetermined level.

A second exposure/imaging is performed by device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HJD developer system. A power supply (not shown) serves to electrically bias the developer structure to a level effective to develop the discharged image areas with negatively charged yellow toner particles 40.

The above procedure is repeated for a third image for a third suitable color toner such as magenta and for a fourth image and suitable color toner such as cyan at stations E and F, respectively. The exposure control scheme described below may be utilized for these subsequent imaging steps. In this manner a full color composite toner image is developed on the photoreceptor belt. The timing of the various imaging stations is sensed and controlled by the system as described below.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by the sheet feeding apparatus 200. The sheet of support material is then brought into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to a catch tray, stacker, finisher or other output device (not shown), for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush or plural brush structure contained in a housing 66.

It is believed that the foregoing description is sufficient for the purposes of the present application to illustrate the general operation of a color printing machine.

As described above, image on image (IOI) single pass xerographic engines are designed such that different colors are laid on top of each other, all in one pass of the photoreceptor (P/R) belt 10. In order for this to happen, each color has its own image station that consists of a charge device, raster output scanner (ROS), (determines how the latent image appears on the P/R belt), a developer (applies the colored toner to the latent image on the belt) and a belt hole sensor which signals the ROS to begin to lay the image. Therefore, if an IOI single pass engine applies four colors, there will be four image stations, each consisting of a charge device, ROS, developer and belt hole sensor.

As stated above the ROS needs some timing signal to apply the latent image at the right time for its respective color. In the past, this signal has been provided by holes on the edge of the photoreceptor belt. As a belt hole passes by an image station, the belt hole sensor for that image station provides a signal for the ROS to begin writing the latent image on the belt. For ten pitch operation, there would be ten holes on the belt. The first hole is larger than the others (this can be detected by the belt hole sensor signal) and signifies the location of the seam on the belt. The problem with this design is that the belt must be changed when pitch mode is changed; e.g. 8 pitch mode requires only 8 holes and the holes would be separated differently than a 10 pitch mode belt. Furthermore, this design requires four separate sensors—one for each image station.

The virtual belt hole system is capable of generating belt holes for 4 to 25 pitch modes and its only limitation for even higher pitch modes is microprocessor capability. When using this algorithm, there is only one hole required on the belt, the seam hole. All other holes are generated by VBH system electronically. Also there is only one sensor required with this design.

The virtual belt holes that are generated by the VBH system look the same as a signal that would be generated by a sensor that sensed a real belt hole as it passed by at process speed. Moreover, the belt holes that are generated by the VBH system are more precise than those generated by a typical sensor reading a hole as the belt passes. In summary, this method uses one belt for any one of seven pitch modes as opposed to 7 different belts for 7 different pitch modes. The signals are more precise and only one belt hole sensor is required with VBH as opposed to 4 without it.

The virtual belt holes are created by the VBH system. The VBH system is a part of the overall P/R belt drive control system which also controls the speed and steering functions of the P/R belt. The printed wire board assembly (PWBA) of the preferred embodiment consists of a microprocessor which is programmed with firmware, however, it is also possible to perform the same function with a software application. The board also has hardware to read inputs into the microprocessor and hardware to allow the microprocessor to produce outputs.

A photoreceptor encoder and a seam hole signal are two inputs to the P/R PWBA that are used for belt control system. The virtual belt hole system makes use of these pre-existing signals:

Encoder feedback: The encoder 80 is attached to a roll on the photoreceptor and is used for motion control algorithms. The virtual belt hole system uses this signal 82 for position feedback.

Seam hole: The seam hole provides once around feedback for motion control systems. The virtual belt hole system uses this signal for reference to count encoder signals. It also is the key to determining where the belt holes will be generated since imaging can not take place near the belt seam.

The VBH system makes use of signals that are already required by the P/R PWBA.

In an effort to minimize the system electronic buss traffic, the Virtual Belt Hole (VBH) system was designed to require as few download parameters as possible. The following table lists the required parameters that need to be downloaded to initialize the image sync generation (VBH). After initialization, only three parameters (Seam_To_Image2, Images_Per_Rev, and Image_To_Image) require update for each change in pitch on the photoreceptor belt. Seam to image 1 and seam to image 2 are unique distances, only seam to image two will change for new pitch modes.

TABLE 1

Parameter downloads for Image Sync Generation

| Parameter | Description |
|---|---|
| SeamSensor_To_ROS1 | Distance (mm) from Seam Hole Sensor to Image Station1 |
| SeamSensor_To_ROS2 | Distance (mm) from Seam Hole Sensor to Image Station2 |
| SeamSensor_To_ROS3 | Distance (mm) from Seam Hole Sensor to Image Station3 |
| SeamSensor_To_ROS4 | Distance (mm) from Seam Hole Sensor to Image Station4 |
| Seam_hole_length | Length of the Seam Hole (Default = 6 mm) |
| Belt_Hole_length | Length of Belt Hole (Default = 4 mm) (min = 2 mm) |
| Seam_To_Image1_Offset | Distance past the Seam Hole for the placement of Image Sync pulse for the 1st image panel. |
| Seam_To_Image2_Offset | Distance past the Seam Hole for the placement of image sync for the 2nd panel. |
| Image_Per_Rev | Number of pitches per belt rev. |
| Image_to _Image | Distance (mm) between images on the belt |

The above parameters must be downloaded to the P/R controller prior to the respective seam. All values are buffered since different VBH stations will often be working on different belt revolutions. The new pitch information will take place on the next belt revolution for each image station regardless of when the information is received.

The VBH system is designed to be transparent to a 10-hole belt but provide programmability to other pitches.

Seam_Hole_time is the value of a counter when the last seam occurred. It is clocked by the P/R encoder which provides a rate of ~0.15 mm/count. It is used as a reference point for one belt revolution. Seam_Hole_time is buffered (maximum of 2) for a belt revolution since a new seam hole event may occur on image station 1 while image station 4 has not yet completed the prior belt rev. This insures that all image syncs on a belt rev are referenced to the same point.

Figure 2:
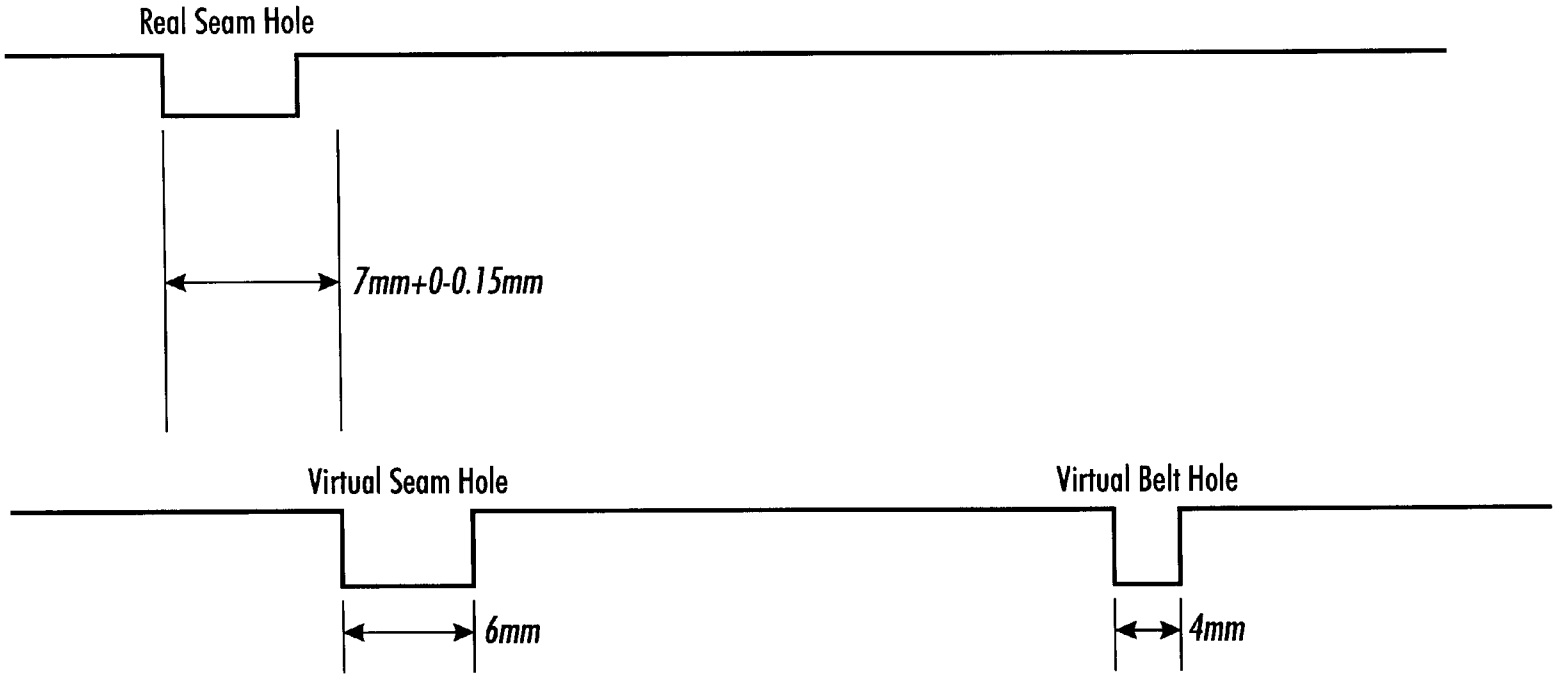
FIG. 2 is a graphical representation of the relationship between the actual hole and the virtual belt holes.
Figure 3:
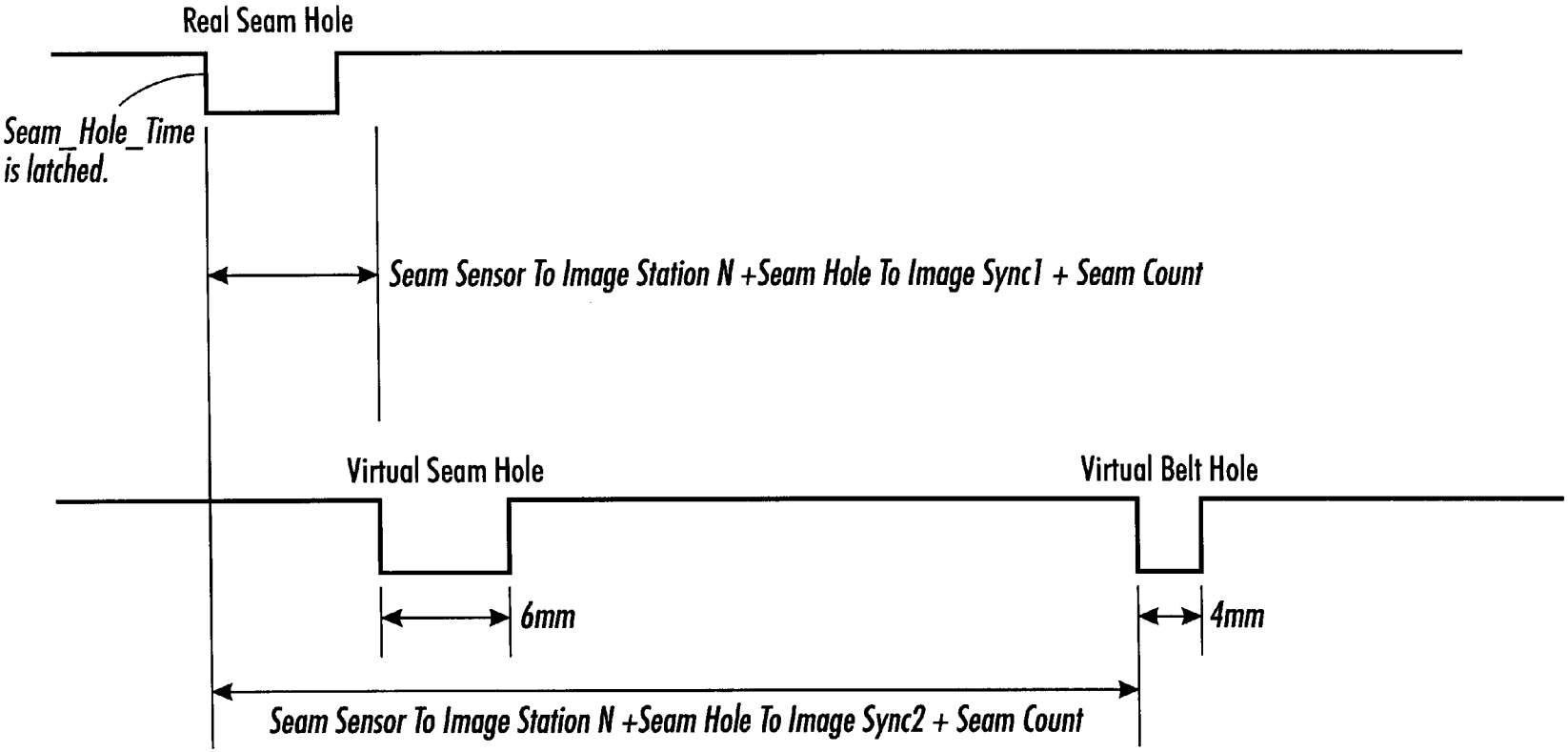
FIG. 3 is a graphical representation of the relationship between the actual hole and the virtual belt holes indicating the distance between the first and second images.
Figure 4:
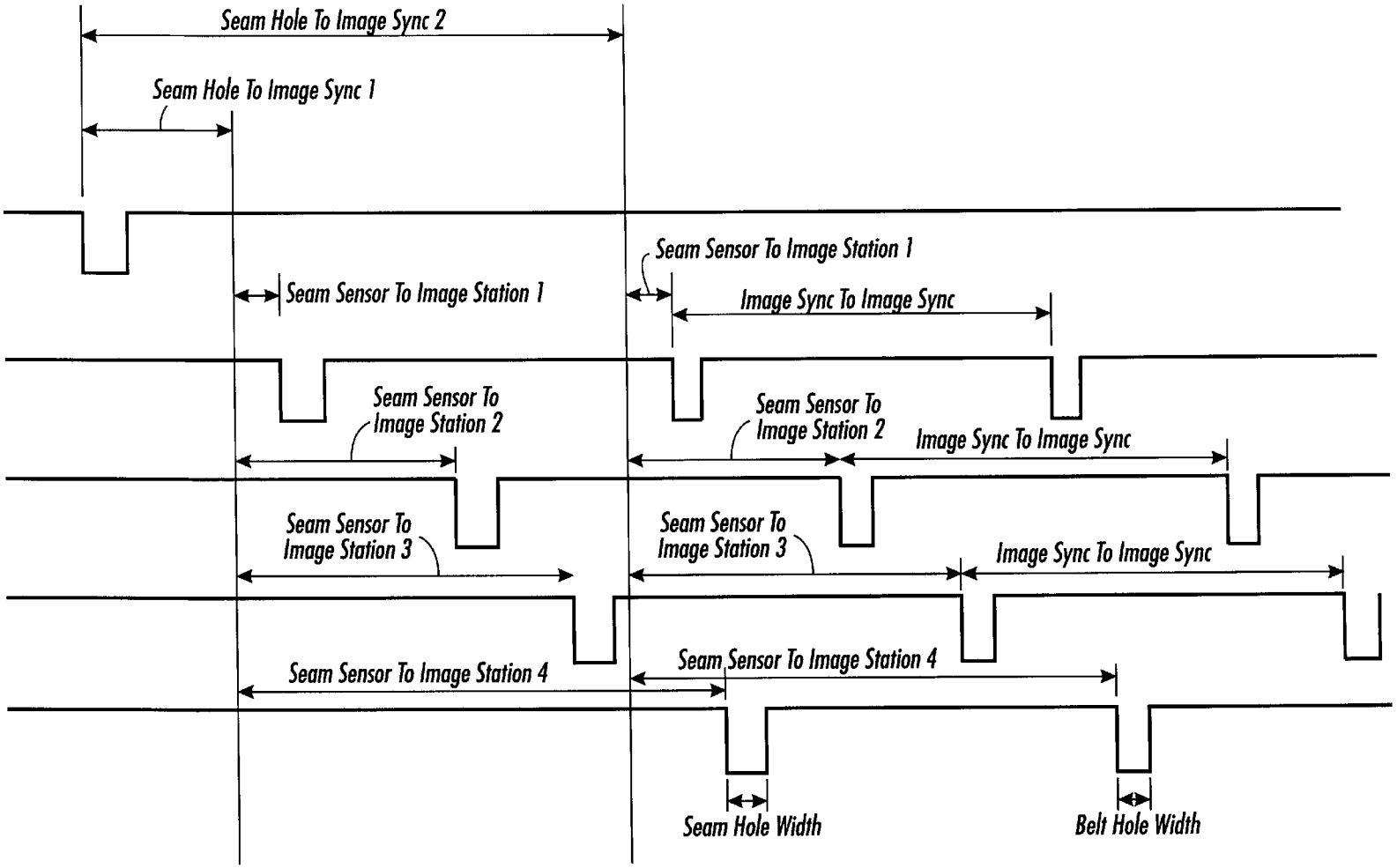
FIG. 4 is a composite graphical representation illustrating a several cycle image formation.

As illustrated in FIGS. 2–4, to synchronize the first imaging station the first belt hole at each image station will be the equivalent of a seam hole in length 6 mm by default (12.8 ms @100 ppm). The signal is delayed by 7 mm (Seam_to_Ros1+Seam_To_Image 1=7 mm nominal) from the real seam input. This allows proper detection of the seam as well as compatibility with the present implementation using 10-hole belts.

Image Station $\sqrt[4]{N}$: LeadEdge1=Seam_To_RosN+Seam_Hole_time+Seam_To_Image1

Image Station $\sqrt[4]{N}$: TrailEdge1=LeadEdge1+Seam_Hole_Length

Where N=1–4

All other belt holes will last a duration equivalent to 4 mm in length by default (8.55 ms @100 ppm).

Seam to image 1 and seam to image 2 distances are unique since the spacing is different from all other images.

Image Station $\sqrt[4]{N}$: LeadEdge2=Seam_To_RosN+Seam_Hole_Time+Seam_To_Image2

Image Station $\sqrt[4]{N}$: TrailEdge2=LeadEdge2+Belt_Hole_Length

Where N=1–4

The remaining image spacings are fixed. (They can be modified by changing the Seam_To_RosN parameter).

Image Station $\sqrt[4]{N}$: LeadEdge(X)=LeadEdge(X−1)+Image_To_Image

Figure 5:
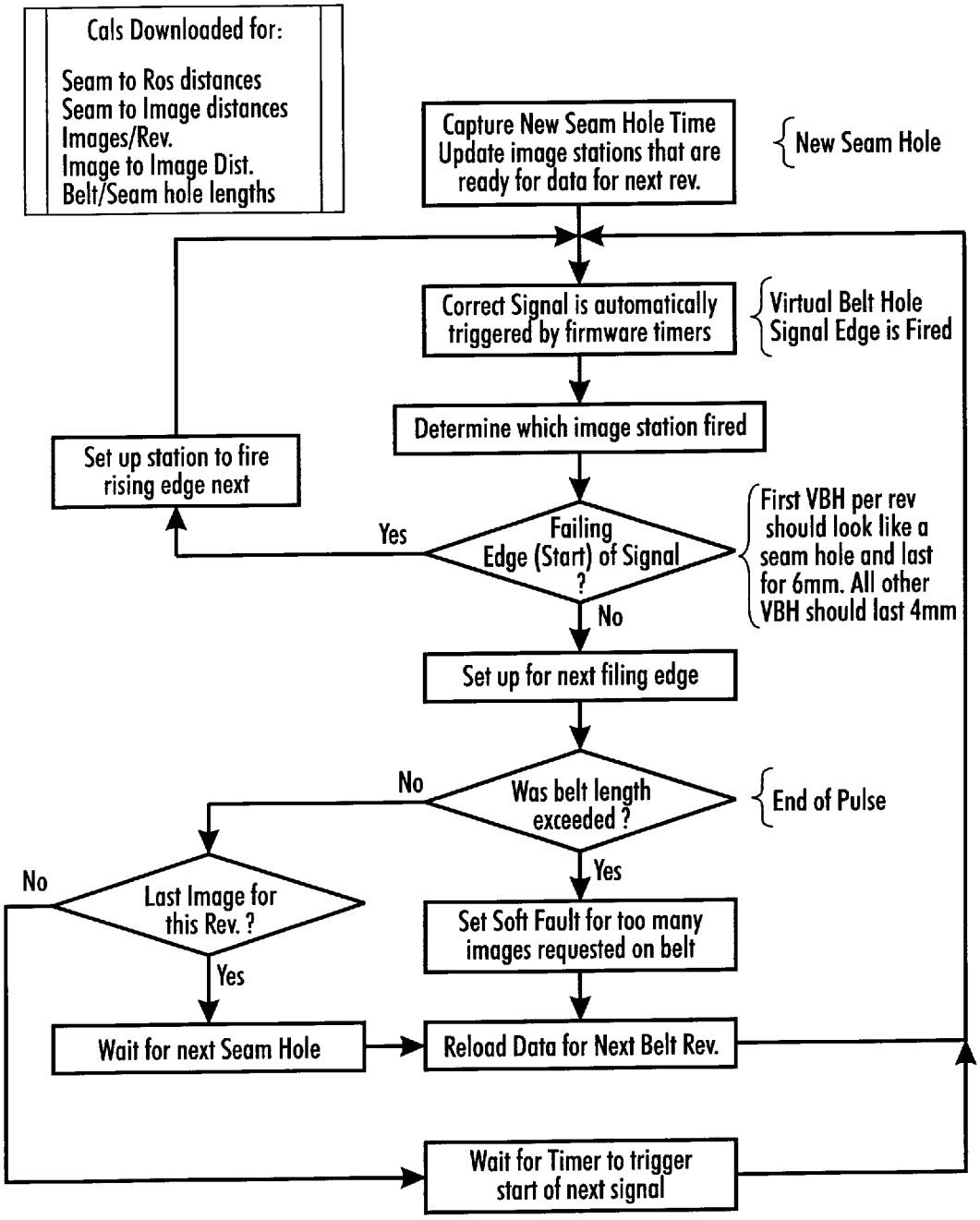
FIG. 5 is a flow diagram illustrating the operation of the system.

Image Station $\sqrt[4]{N}$: TrailEdge(X)=LeadEdge(X)+Belt_Hole_Length

Where N=1–4

Where X=3 up to Image_Per_Rev (assuming Image_Per_Rev>2) LeadEdge(X−1) represents the prior LeadEdge The real seam hole is asynchronous to the P/R encoder. As a result, the first image sync signal will only be accurate to 1 P/R encoder count (321 $\mu$sec. or 150 microns) with respect to the real seam. Therefore, all the images on the belt may move 150 $\mu$m relative to seam hole on any subsequent belt revolution. This, however, has no impact on IOI registration since the image to image spacing will be repeatable to within 1 $\mu$S. There is no impact on paper registration since paper registration is synchronized with image placement (not the seam). FIG. 5 illustrates a flow diagram for the system operation at the first imaging station.

In recapitulation, there is provide a system for controlling the imaging device in a single pass multi color electrophotographic printing machine, comprising a photoconductive member defining a timing aperture, the member moving along a path in a printing machine and a plurality of imaging devices, each one of the plurality of imaging devices writing a latent image on the photoconductive member. The system further includes a sensor, located adjacent the photoconductive member, to sense the aperture in the photoconductive member as it passes the sensor and generate a signal indicative thereof and a control device, which generates a timing signal for each of the plurality of imaging devices as a function of the signal generated by the sensor and a plurality of predetermined parameters.

While the embodiments disclosed herein are preferred, it will be appreciated from this teaching that various alternatives, modifications, variations or improvements therein may be made by those skilled in the art, which are intended to be encompassed by the following claims.

What is claimed is:

1. A system for controlling the imaging device in a single pass multi color electrophotographic printing machine, comprising:

a photoconductive member defining a timing aperture, said member moving along a path in a printing machine;

a plurality of imaging devices, each one of said plurality of imaging devices writing a latent image on said photoconductive member;

a sensor, located adjacent said photoconductive member, to sense the aperture in said photoconductive member as it passes said sensor and generate a signal indicative thereof;

a control device, which generates a timing signal for each of said plurality of imaging devices as a function of the signal generated by said sensor and a plurality of predetermined parameters.

2. A system according to claim 1, wherein said plurality of predetermined parameters includes the distance between the timing aperture and the second one of an image to be formed on said photoconductive member.

3. A system according to claim 1, wherein said plurality of predetermined parameters includes the distance between a first and second image to be formed on said photoconductive member.

4. A system according to claim 1, wherein said plurality of predetermined parameters includes the number of images to be formed on said photoconductive member as said photoconductive member makes a full circuit along the path.

5. A system according to claim 1, further comprising an encoder operatively coupled with said photoconductive member to generate a signal indicative of the movement thereof along the path.

6. A method of controlling the formation of images on a photoconductive member in a multi color single pass electrophotographic printing machine comprising:

sensing a timing aperture in the photoconductive member as the member moves along a path in a printing machine;

generating a timing signal for each of a plurality of imaging devices as a function of the signal sensed and a plurality of predetermined parameters.

7. A method according to claim 6 wherein one of said plurality of predetermined parameters includes the distance between the timing aperture and the second one of an image to be formed on said photoconductive member.

8. A method according to claim 6 wherein one of said plurality of predetermined parameters includes the distance between a first and second image to be formed on said photoconductive member.

9. A method according to claim 6 wherein one of said plurality of predetermined parameters includes the number of images to be formed on said photoconductive member as said photoconductive member makes a full circuit along the path.

10. A method according to claim 6 further including inputting an encoder output to track the movement of the photoconductive member.

* * * * *